United States Patent [19]

Smith, III

[11] 4,408,103

[45] Oct. 4, 1983

[54] JOYSTICK OPERATED MULTIPLE POSITION SWITCH

[75] Inventor: Jay Smith, III, Pacific Palisades, Calif.

[73] Assignee: Smith Engineering, Santa Monica, Calif.

[21] Appl. No.: 337,228

[22] Filed: Jan. 6, 1982

[51] Int. Cl.[3] ..... H01H 13/70; H01H 25/00

[52] U.S. Cl. ..... 200/6 A; 200/5 A; 200/17 R; 200/153 K

[58] Field of Search ..... 200/5 A, 6 A, 153 K, 200/17 R, 18

[56] References Cited

U.S. PATENT DOCUMENTS

| | | | |
|---|---|---|---|
| 3,731,013 | 5/1973 | Nightengale | 200/6 A X |
| 3,760,137 | 9/1973 | Shimojo et al. | 200/5 A X |
| 3,879,586 | 4/1975 | DuRocher et al. | 200/5 A |
| 3,898,421 | 8/1975 | Suzumura | 200/5 A X |
| 3,988,556 | 10/1976 | Hyodo | 200/6 A X |
| 4,029,915 | 6/1977 | Ojima | 200/6 A X |
| 4,246,452 | 1/1981 | Chandler | 200/5 A |

*Primary Examiner*—J. R. Scott

*Attorney, Agent, or Firm*—Jackson, Jones & Price

[57] ABSTRACT

A multiple position switch having a plurality of contact regions on, e.g., a PCB and corresponding conductive regions mounted on a piece of resilient material resting on the surface, with each conductive region contained within a hollowed portion of the resilient material to be thereby spaced apart from the respective contact region, and having a swivelingly mounted joystick, the joystick having a plurality of urging members positioned radically outward from the longitudinal axis of the joystick corresponding in number and position to the number and position of the respective contact regions. Also disclosed are separate embodiments in which the conductive regions are, on the one hand, electrically insulated from each other and the respective contact regions are formed by pairs of contacts between which electrical contact is to be made, and, on the other hand, electrically connected to each other and a common, with the contact regions formed of a single contact to which electrical connection with the common is desired to be made. Also, alternative embodiments of the joystick are disclosed wherein the urging members form protrusions either from a plurality of radically extending legs or a plurality of triangular segments forming a poly-sided disc.

6 Claims, 12 Drawing Figures

FIG. 1
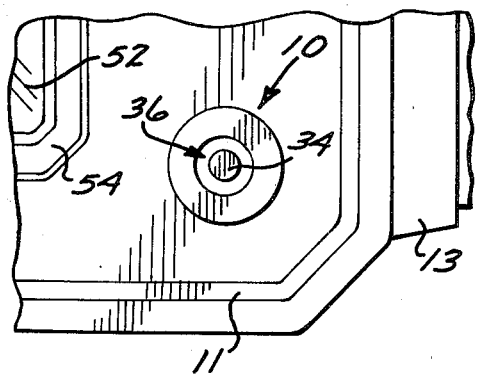
FIG. 2
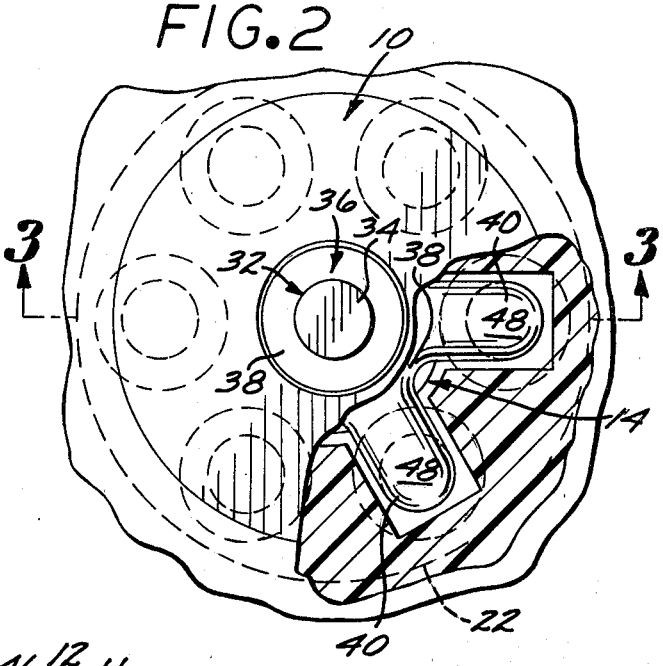
FIG. 3
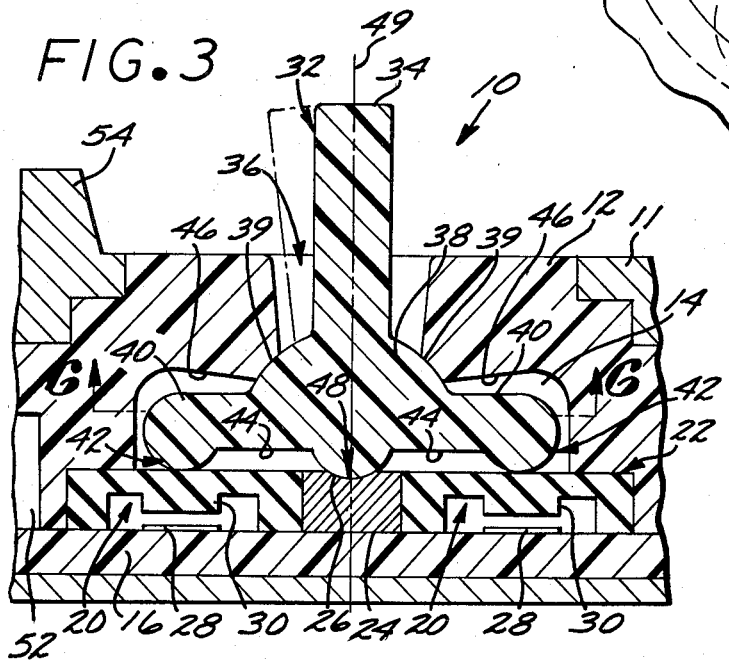
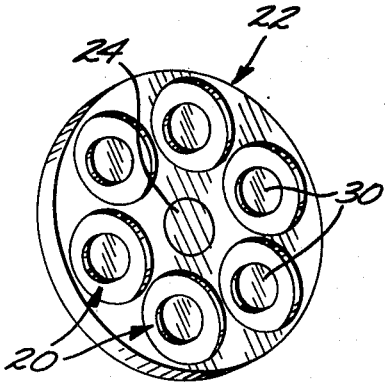
FIG. 4
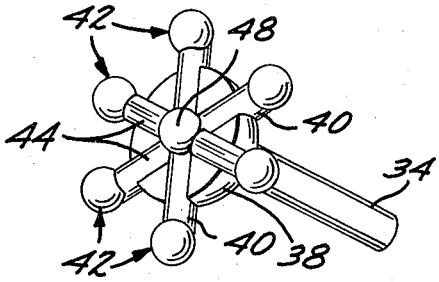
FIG. 5
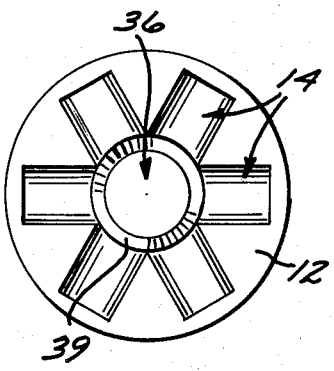
FIG. 6

JOYSTICK OPERATED MULTIPLE POSITION SWITCH

BACKGROUND OF THE INVENTION

This invention relates to a novel multiple position switch. More particularly, this invention concerns a joy stick type switch, which in one of its uses is particularly suited for use with an electronic game watch, of the kind disclosed in a co-pending patent application assigned to the assignee of the present application and of which the applicant is a co-inventor, having a Ser. No. 270,314, filed on June 4, 1981. In such use the size constraints dictated by the size of the housing containing the electronic game and display, in that instance a wrist watch, make the switch of the present invention particularly suitable.

In the past it has been known, as shown in the above-referenced patent application, to incorporate electronic games in very small packages, e.g., a wrist watch housing, with the face of the wrist watch having a particularly suited liquid crystal diode (LCD) display which is controlled by a programmed data processor contained within the, e.g., watch housing, and by player input through various buttons on the watch housing. It has also been known to employ a so-called joy stick for input to electronically controlled games, e.g., of the arcade game variety or of the variety played on a home television screen, e.g., the "Atari" TM video games. In these instances the joy stick may be of a rather large variety, as it is either mounted on a large game chassis or on a hand-held unit which itself comprises a joy stick alone, or perhaps the joy stick with some other player control input buttons. Other types of player control inputs which perform the function of a so-called joy stick are also known in the art, e.g., the disc-shaped switch used in the "Intelevision" TM home video game, made by Mattel, in which depressing the rim of the disc at a selected location about the rim depresses one of a plurality of pressure operated switches positioned beneath the rim of the disc.

In the case of the arcade game type switches, the movement of the joy stick about a neutral axis selectively activates one of a plurality of switches which are normally spring-loaded to the open position. In the case of the "Atari" joy stick, swiveling the joy stick about a neutral axis selectively depresses a respective one of the plurality of pressure-operated switches, e.g., dome-type switches due to the action of a disc-shaped member at the lower end of the joy stick and a plurality of springs depending from the underside of the disc. Such dome switches can be of the type manufactured by Texas Instruments, and commonly used in hand-held calculators on the market today. The dome switch generally comprises a concave piece of thin metal which makes contact at its periphery with a lead on a printed circuit board (PCB) and has a protrusion at its apex, which when depressed against the resilient biasing of the metal material, by pressing, e.g., a respective one of the buttons on a hand-held calculator, makes electrical contact with another lead on the PCB.

It is also known to use a joy stick, which is mounted in a double gimble arrangement, having a means for generating an X-Y coordinate signal, which is representative of the position to which the joy stick is swivelled off of a neutral axis, by sensing the change of position of the joy stick on its X axis gimble and the change of position of the joy stick on its X axis gimble.

Such joy sticks known in the art have certain limitations to which the present invention is directed to solving. By way of example, the gimble joy stick, which typically uses potentiometers to sense the change in position along the X and Y axes, suffers from the defect of having to zero the potentiometers on occasion, or else the neutral axis position of the joy stick would not be a zero output position for either or both of the X and Y potentiometers. The joy sticks of the prior art are generally bulky and difficult to manufacture, and except for the gimble arrangement discussed above, require a plurality of spring-loaded switches which must generally be separately manufactured and incorporated into the joy stick switch. Further, the joy sticks, except for those of the type used in the "Atari" TM games, are very unsuited for making direct contact between two printed leads on, e.g., a PCB, as are commonly used in microprocessors or other large scale integrated circuit data processing equipment. The "Atari" TM type joy sticks are not well suited for miniaturization due to limits on how small a dome switch can be made. In addition, the joy sticks of the prior art are particularly unsuited for operation by use of a single finger. Such operation, for example, would be required with the wrist watch game described in the above-noted patent application, in order to control the joy stick while leaving other fingers on the same hand free to manipulate other game buttons, when only one hand is available, due to the wrist watch game remaining on one wrist of the game player.

The problems enumerated in the foregoing are not intended to be exhaustive, but rather are among many which tend to impair the effectiveness of previously known multiple position switches. Other noteworthy problems may also exist; however, those presented above should be sufficient to demonstrate that the multiple position switches appearing in the art have not been all together satisfactory.

While such arrangements as described above as existing in the prior art exhibit a degree of utility in the art of multiple position switches, room for significant improvement remains. Recognizing the need for an improved multiple position switch, it is, therefore, a general feature of the present invention to provide a novel multiple position switch which minimizes or reduces the problems of the type previously noted. It is another feature of the present invention that the multiple position switch of the present invention is particularly adapted for application where the switch must be very small in size in comparison to the joy stick multiple position switches existing in the art. It is an additional feature of the present invention to make a joy stick which is easy to manufacture and has a minimum of moving parts.

It is a further feature of the present invention that the switch of the present invention is particularly suited for selectively making contact between pairs of printed circuit board leads printed on the surface of the printed circuit board.

A multiple position switch according to a presently preferred embodiment of the invention, intended to substantially accomplish the foregoing, includes a plurality of contacts on a surface, e.g., of a PCB, a conductor, mounted on a piece of resilient material which rests on the surface, with the conductor being spaced apart from the surface and the contacts on the surface by being contained in a hollowed-out portion of the resilient material, and having a swivelingly mounted joy stick, the joy stick having a plurality of urging members positioned radially outward from the longitudinal axis of the joy stick, corresponding in position to the position of the respective contacts on the PCB.

Examples of the more important features of the present invention have thus been outlined rather broadly in order that the detailed description thereof that follows may be better understood, and in order that the contribution to the art may be better appreciated. There are, of course, additional features of the invention that will be described hereinafter and will also form the subject of the appended claims. These features and advantages of the present invention will become apparent with reference to the following detailed description of a preferred embodiment thereof in connection with the accompanying drawings, wherein like reference numerals have been applied to like elements, in which:

BRIEF DESCRIPTION OF THE DRAWINGS

FIG. 1 depicts a portion of an electronic game watch showing the location of a switch according to the present invention on the housing of the game watch;

FIG. 2 shows a plan view of a switch according to the present invention as shown in FIG. 1 with a portion of the switch housing cut away;

FIG. 3 shows a cross-sectional view of a switch according to the present invention along section lines 3—3 in FIG. 2;

FIG. 4 is a perspective view of a resilient disc containing conductors as shown in FIG. 3;

FIG. 5 is a perspective view of a joy stick according to the present invention, as shown in FIG. 3;

FIG. 6 is a plan view of a portion of a switch housing according to the present invention taken along section lines 6—6 in FIG. 3, with the joy stick removed for clarity of illustration;

DETAILED DESCRIPTION OF A PREFERRED EMBODIMENT OF THE INVENTION

Figure 7:
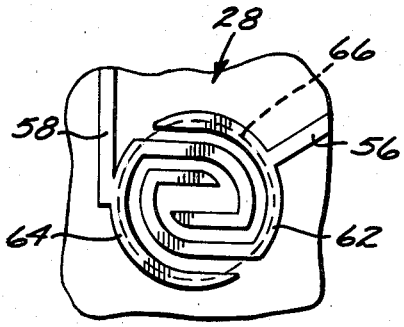
FIG. 7 shows one of a plurality of pairs of contacts as shown in FIG. 3.

Turning first to FIG. 1, a joy stick type multiple position switch 10, according to the present invention, is shown contained on the housing 11 of a game watch of the type illustrated in the above-referenced patent application. FIG. 1 illustrates one corner of the top facing of the watch and a portion of the wrist band connector 13.

The joy stick type multiple position switch 10 is illustrated in further detail in FIGS. 2 and 3, wherein FIG. 2 is a plan view, partially cut away, of the switch 10 as shown in FIG. 1, and FIG. 3 is a cross-sectional view of the multiple position switch 10 taken along section lines 3—3 of FIG. 2.

Turning now to FIGS. 2 and 3, it can be seen that the multiple position switch 10 is contained within a switch housing 12. The housing 12 is hollowed to form an interior chamber 14 as is described in further detail below. The switch housing 12 rests on a surface which may, e.g., be the upper surface of a printed circuit board 16 with the chamber 14 of the switch housing 12 being partially defined by the surface of the printed circuit board 16. Occupying a portion of the chamber 14, adjacent the surface of the printed circuit board 16 facing the chamber 14, is a piece of resilient material 22, composed, e.g., of a synthetic rubber, which may, e.g., be in the form of a disc, as shown in more detail in FIGS. 4 and 10, depending on the shape of the corresponding portion of the chamber 14. Located in the center of the resilient disc 22 is a rigid hub 24 which may be constructed of a metal, e.g., brass, or a plastic which is suitably rigid, as will be described in more detail below. The hub 24 has a concave bearing surface 26.

Spaced about the hub 24, in a selected pattern, e.g., a circular pattern, in one embodiment of the present invention, are a plurality of pairs of contacts 28 printed on the printed circuit board 16, as are described more fully below.

The resilient disc 22 in the embodiment of FIG. 4 is formed with a plurality of closing contact hollows, which define closing contact chambers 20, corresponding in position and location to the position and location of each pair of contacts 28 on the printed circuit board 16. Within each of the closing contact hollows 20 is a closing contact 30 protruding from the surface of the closing contact hollow 20 facing the respective one of the pairs of contacts 28. The closing contacts 30 are made of a conductive material, as for example, conductive rubber. Conductive rubber, due to its high content of e.g., carbon, will still conduct electricity. The conductive rubber of the contacts 30 is affixed to the resilient material of the disc 22, for example, during an injection molding process used to form the disc 22. The conductive rubber is placed in the mold first at appropriate points on the contour of the mold, the mold is closed and the remainder of the disc is subsequently injected into the mold. It is also possible that the disc 22 and conductors 30 can be formed of a single piece of resilient conductive material, e.g., conductive rubber from which a part of the conductive resilient material forming the disc 22 is removed, as by stamping, to leave openings forming the respective closing contact chambers 20 and protruding contacts 30 in the embodiment of FIG. 4 or 10. However, this may not be as convenient, since some provision will have to be made to insulate the part of the disc resting on the PCB from the PCB leads in order to prevent shorting the switch contacts continuously, regardless of the operation of the multiple position switch 10 of the present invention. It will also be understood that the present invention could also be fabricated by using a conductive material which is metallic rather than conductive rubber for the conductors 30. In this case a thin film or foil of conductive metal could be placed on the surface of raised portions within the hollows 20, formed by molding or stamping the disc 22.

The multi-position switch 10 also has a so-called joy stick generally referred to as 32. The joy stick 32 includes a manipulating rod 34 which extends outwardly from the interior chamber 14 of the switch 10 through a bore 36 in the housing 12. Toward the end of the manipulating rod 32 extending into the interior chamber 14 of the switch 10 is a partial hemispherical dome 38 which surrounds the manipulating rod 34, as is more particularly shown in FIG. 5. Extending radially outward from the manipulating rod 34 at generally the base of dome 38 are a plurality of legs 40, each of which has a protuberance 42 at the terminal end thereof. The protuberances 42 may, as shown, take the form generally of a ball at the terminal end of each leg 40. The protuberances 42 are formed to at least extend below the plane of the lower surface 44 of each leg 40, so as to have the protuberance rest on the disc 22, as shown in FIG. 3, while the lower surface 44 of the respective leg is spaced apart from the disc 22 by a distance at least slightly greater than the distance separating the respective conductor 30 and switch contacts 28.

At the internal terminal end of the manipulating rod 34 is a swivel mounting 48 in the form of a hemisphere which extends into and is swivellingly engaged by the bearing surface 26 of the hub 24.

As is shown in more detail in FIG. 6, the interior chamber 14 of the switch 10, in the region occupied by the dome 38 and legs 40 of the joy stick 32 is formed into a plurality of separate chambers corresponding in location to the respective plurality of legs 40. Each of the separate chambers has an upper surface 46 which is shaped, e.g., by slanting inwardly and downwardly as shown in FIG. 3, to allow the respective leg 40 some freedom of movement in the upward direction of FIG. 3. Thus, for example, for the legs 40 shown in FIG. 3, when the manipulating rod 34 is forced off of the neutral axis 49 in the plane of the paper, as illustrated in FIG. 3, away from one of the legs 40 and toward the other of the legs 40 shown in FIG. 3, the one leg moves downwardly within its portion of the interior chamber 14 and the other leg moves upwardly within its portion of the interior chamber 14. The sidewalls of the separate parts of the interior chamber 14 corresponding to each leg 40 are spaced apart by a distance which, in relation to the maximum width of the leg 40 and protuberance 42, allows the respective leg 40 little, if any, degree of rotational movement about the neutral axis 49. This assures that each protuberance 42 remains correctly aligned above its corresponding conductor 30 and contacts 28.

The interior portion of the switch housing 12, at the internal terminal end of the bore 36, forms a bearing surface 39 which slidably engages the dome 38, and together with the bearing surface 26 and swivel mounting 48, maintains the joy stick 32 in a firmly held relation to the switch housing 12, while allowing the manipulating rod 34 to be swivelled to any position, limited only by the size of the bore 36.

FIG. 3 also shows, by way of example, the location within the watch of the display formed by a liquid crystal diode 52, which is framed by a frame 54 to form the watch face.

FIG. 7 shows the arrangement of contacts 28 in the form of adjacent pairs on the printed circuit board 16. Shown are a pair of first and second leads 56 and 58, between which electrical contact is desired to be made by the depression of a respective conductor 30 in response to downward movement, as illustrated in FIG. 3, of the respective leg 40. The leads 54 and 58 have formed at the terminal ends thereof a pair of respective interlocking, but spaced apart and electrically insulated, spiralling fingers 62 and 64. The phantom line 66 illustrates the approximate coverage of the respective conductor 30 when depressed to contact the surface of the PCB 16, thereby making electrical contact between the fingers 62 and 64, and therefore the contacts 56 and 58.

Figure 8:
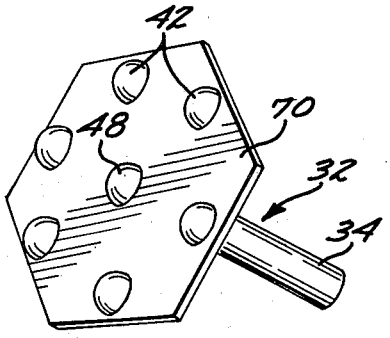
FIG. 8 shows a perspective view of another embodiment of a joy stick according to the present invention.
Figure 9:
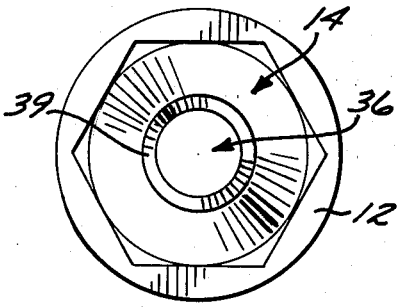
FIG. 9 shows the view of FIG. 6 as it would appear with the joy stick embodiment of FIG. 8.

An alternative embodiment of the joy stick 32 of the present invention is shown in perspective view in FIG. 8. In this embodiment the legs 40 of the joy stick 32 of FIG. 5 have been joined, forming a hexagonal-shaped disc 70 at the swivel mounting end of the joy stick 32. The swivel mounting 48 protrudes from the center of the disc 70 along with the six protuberances 42, each in the form of a hemisphere. As can be seen in FIG. 9, the portion of the interior chamber 14 which was formed, as shown in FIG. 6, into separate chambers for the respective legs, is formed in the present embodiment into a corresponding hexagonal shape to thereby prevent rotation of the manipulating rod 34 about its longitudinal axis to keep the protuberances 42 aligned properly.

Figure 10:
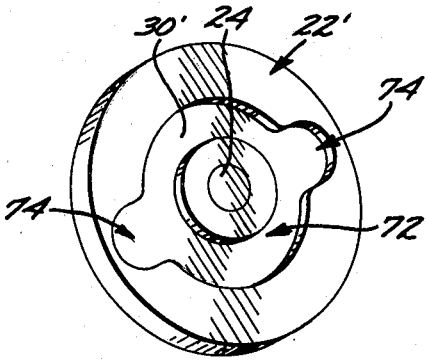
FIG. 10 shows a perspective view of an alternative embodiment of the resilient disc of FIG. 4.
Figure 11:
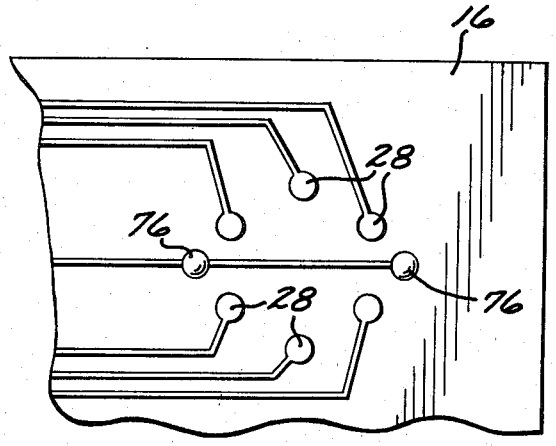
FIG. 11 shows the arrangement of contacts on the PCB according to the embodiment of FIG. 10; and, FIG. 12 shows a perspective view of the comparison between a ground contact and a discrete switch contact on the PCB according to the embodiment of FIG. 10.
Figure 12:
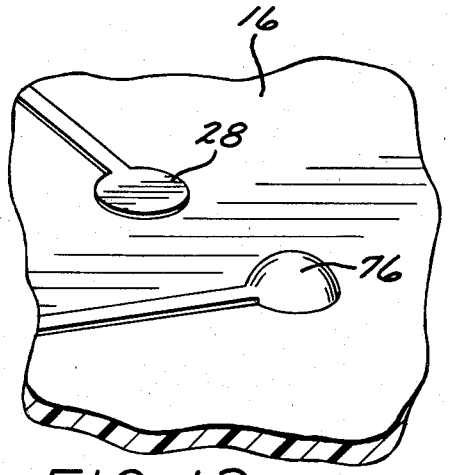

An alternative embodiment for the contacts 28 and conductors 30 is shown in FIGS. 10, 11 and 12. In FIG. 10 it is shown that the resilient disc 22' can be formed with a single closing contact chamber 72, which is concentric with the disc 22' and hub 24. In this embodiment the surface of the chamber 72 facing the surface of the PCB 16 is coated with a conductive material 30' which, as explained above, may be, e.g., conductive rubber or a thin film or foil of metal. Two ears 74 are formed on the closing contact chamber 72 on opposing sides thereof and also have a coating of conductive material 30'. The ears 74 are positioned over contacts on the PCB 16 which correspond to ground, i.e., common. Two such contacts are provided to give redundance for a ground connection to assure it exists. The PCB 16, as shown in FIG. 12, has raised contacts 76 at the points where the ears 74 of the disc 22' are to make contact therewith. The disc 22' might be keyed in some way to ensure that during assembly the ears 74 align with the ground contacts 76. This is not shown but may easily be done by fabricating the disc 22' with a cutout which must mate with a similarly shaped member in the switch housing chamber 14 where the disc 22' is inserted. Alternatively, the disc 22' could be made itself to have ears, e.g., in a position corresponding to that of ears 74, with the housing chamber 14 formed to receive a disc of such shape, which would ensure proper alignment by the ears of the disc 22' mating with the chamber 14 shape.

As shown in FIGS. 11 and 12 the PCB contacts 28 are in the form of a single circle of conductive metal on the surface of the PCB 16. In this embodiment a more positive contact can be insured between the conductive material 30' on the disc 22 and the contact 28 when the protuberance 42 is of a shape which will result in essentially a point contact being made between the two. It will be understood that the ears 74 could be formed on a part of the disc 22 which rests on the surface of the PCB 16, rather than in the hollow 72 as shown in FIG. 10. In this event, the need for raised contacts 76 on the PCB can be eliminated.

In operation, the multiple position switch 10 of the present invention has a neutral position in which the longitudinal axis of the manipulating rod 34 is aligned with the neutral axis 49 as shown in FIG. 3, and in which none of the conductors 30 (or no part of the conductive material 30' of FIG. 10) is depressed toward the contacts 28 on the surface of the printed circuit board 16 against the resilient urging of the material of the disc 22' 22'. The resiliency of the material of the disc 22' 22' maintains the conductor 30, 30' in a spaced-apart relation to the printed circuit board 16. When the manipulating rod 34 is swivelled in the plane of paper to a position, e.g., as shown in phantom in FIG. 3, the leg 40 (or in the case of the embodiment of FIG. 8, one of the triangular segments forming the hexagon 70) on the left-hand side of FIG. 3 moves toward the printed circuit board 16 to depress the adjacent portion of the disc 22 with the associated conductor 30, 30' in a direction to make contact with the respective contact(s) 28 on the printed circuit board 16, according to the different embodiments of FIGS. 4 and 10. At the same time the leg 40 (or segment of the hexagonal disc 70) on the right-hand side of FIG. 3 moves in a direction towards the surface 46 of the respective portion of the interior chamber 14 of the switch containing that leg 40 (or segment of the hexagonal disc 70). Upon return of the manipulating rod 34 to the neutral axis 49 or swivelling of the manipulating rod 34 in another direction, the resiliency of the material of the disc 22, 22' returns the conductor 30, 30', no longer being depressed, to a spaced-apart relation to the PCB 16. The rigid hub 24 prevents a depression of any of the conductor 30, 30' into contact with its associated contact 28 due to the exertion of force in the direction of the longitudinal axis of the manipulating rod 34. Thus, when the manipulating rod 34 is in the neutral position shown in FIG. 3, exertion of force along the neutral axis 49 will not cause any conductors 30, 30' to make contact with the printed circuit board 16. When the manipulating rod 34 is swivelled in a direction to cause one of the conductors 30 (or a portion of conductor 30') to contact the printed circuit board 16, any resultant force on the manipulating rod 34 in a direction along the longitudinal axis of the manipulating rod 34 will not result in any of the other conductors 30 or portion of the conductor 30' making contact with the printed circuit board 16. The conductors 30 or portions of conductor 30' thus make contact with the PCB 16 only due to the direction in which the manipulating rod 34 is moved from the neutral axis 49.

SUMMARY OF THE ADVANTAGES AND SCOPE OF THE INVENTION

It will be appreciated in constructing a multi-position switch according to the present invention, certain significant advantages are provided. In particular, a multiple position switch of the present invention is inexpensive and easy to manufacture, and also is of particular utility in applications where the size of the switch is of critical importance, or where it is desired to have a switch which can be easily manipulated by finger touch rather than using the entire hand or several fingers of the operator. Thus, when the switch is utilized on a game watch, as described in the above-noted co-pending patent application, the switch of the present invention allows a joy stick-type input to the programmed data processor controlling the game display in a manner similar to a joy stick-type input in, e.g., arcade game or home video games like the "Atari" TM home video game. This provides, as well, multiple switch input to the data processor in a space only as large as a fingertip. Thus, e.g., in an LCD game display similar to that shown in the above-noted co-pending patent application, but having an LCD segment arrangement which allows player selection of movement of a game display element in, e.g., six different directions (e.g., forward, back, right, left, and forward right and left diagonal), the switch of the present invention is very useful in providing the player-desired input to the programmed data processor controlling the game, and in doing so with the use of only one finger of the game player.

It is plainly apparent that the joy sticks employed in prior art-type arcade and video home games would not be suitable for use on the housing of a game watch in accordance with the above-noted co-pending patent application, or, indeed, any other small hand-held arcade-type game incorporating the display and game control inputs into a relatively small hand-held unit.

The foregoing description of the invention has been directed to particular preferred embodiments in accordance with the requirements of the patent statutes and for purposes of explanation and illustration. It will be apparent, however, to those skilled in this art that many modifications and changes in both the apparatus and method of the present invention may be made without departing from the scope and spirit of the invention. For example, it may be desirable to allow contact to occur in two adjacent contact locations on the printed circuit board simultaneously to thereby give as an input to the programmed data processor an indication that the joy stick is in a position intermediate to the two adjacent contact locations on the printed circuit board, as opposed to an indication corresponding to the relative angular position of one or the other of those two contact locations. The present invention is shown in embodiments which allow depression of one protuberance at a time onto the resilient disc. However, with suitable modifications simultaneous depression is possible of two adjacent protuberances sufficiently to make the desired electrical contact between the conductor and the contact(s) on the PCB at adjacent locations. The switch of the present invention also could easily be made with more or less than six positions, i.e., contacts on the PCB. Also, the multiposition switch of the present invention is particularly suited for uses where small size is of great importance. However, the switch is also of use because of its ease of manufacture and assembly and limited number of moving parts. Thus, scaled-up versions of the switch of the present invention could also be considered within the scope of the present invention. It will be further apparent that the invention may also be utilized with suitable modifications within the state-of-the-art which will be apparent to those skilled in this art. By way of example, the rigid hub function can be replaced by, e.g., extending the swivel mounting to an elongated extension of the manipulating rod below the dome and putting a swivel mounting surface on the PCB, which may include countersinking a hole in the PCB to provide a swivel bearing surface. For operator comfort a soft cap made, e.g., of synthetic rubber can be placed on the external end of the manipulating rod. It is the applicant's intention in the following claims to cover all such improvements, modifications and variations that fall within the true spirit and scope of the invention.

What is claimed is:

1. A multiposition switch comprising:

a surface;

a plurality of contact regions on the surface each formed by a pair of first and second adjacent contacts of an electrical switch, one of which being a resilient member, said contacts being spaced apart and electrically insulated one from the other with said resilient member having an indented surface thereon which is spaced apart from the contact regions, and an electrical conductor in electrical contact with a common point for each of the electrical switches formed by the respective contact regions;

said plurality of conductive regions each being located within a separate hollow formed concentrically in the resilient material and thereby spaced apart from the surface, with the conductive region formed in a protrusion within each hollow;

a joy stick mounted in swiveling relation to the surface and having a manipulating rod and a plurality of urging members disposed radially outward from the longitudinal axis of the manipulating rod at generally the swivelingly mounted end of the joy stick, and corresponding in number and position to the number and position of the respective contact regions;

said joy stick, upon being actuated to depress the resilient member, moving at least one of the urging members towards the stationary contact regions, with the urging member aligned with a conductive region bringing this conductive region into contact with an aligned stationary contact region; and the resilient member forming a donut shape about the swivelingly mounted end of the joy stick, with a hub of rigid material located at the center of the donut shaped resilient member and having formed thereon a swivel mounting surface for the swiveling mounting of the joy stick, said hub forming the electrical conductor in the resilient member.

2. The switch of claim 1 further comprising:

a plurality of legs extending radially outward from the longitudinal axis of the manipulating rod at generally the swivelingly mounted end of the joy stick, each leg having at the terminal end thereof a respective urging member.

3. The switch of claim 2 further comprising:

a hub of rigid material located at the center of the donut shaped resilient member and having formed thereon a swivel mounting surface for the swiveling mounting of the joy stick.

4. The switch of claims 2 or 3 further comprising:

the urging members being formed by a protuberance at the terminal end of each leg and extending toward contacting relation with the resilient member.

5. The switch of claim 1 further comprising:

a plurality of segments extending radially outward from the longitudinal axis of the manipulating rod at generally the swivelingly mounted end of the joy stick, each segment joined with its adjacent segments and having disposed thereon an urging member in contacting relation to the resilient member.

6. The switch of claim 5 further comprising:

the plurality of segments forming a polysided disc-shaped member with the urging members forming protuberances extending toward contacting relation to the resilient member.

* * * * *